United States Patent [19]

Agar et al.

[11] 4,156,578

[45] May 29, 1979

[54] CONTROL OF CENTRIFUGAL COMPRESSORS

[75] Inventors: Joram Agar, Houston, Tex.; Klaus J. Zanker, Four Marks, England

[73] Assignee: Agar Instrumentation Incorporated, Houston, Tex.

[21] Appl. No.: 821,106

[22] Filed: Aug. 2, 1977

[51] Int. Cl.[2] ..... F01D 19/00

[52] U.S. Cl. ..... 415/1; 415/17; 415/27; 417/28

[58] Field of Search ..... 415/1, 17, 27; 417/28

[56] References Cited

U.S. PATENT DOCUMENTS

| | | | |
|---|---|---|---|
| 3,240,422 | 3/1966 | Pettersen et al. | 415/27 |
| 3,292,846 | 12/1966 | Harper et al. | 415/17 |
| 3,362,626 | 1/1968 | Schlirf | 415/27 |
| 3,737,252 | 6/1973 | Pilarczyk et al. | 415/27 |
| 4,046,490 | 9/1977 | Rutshtein et al. | 415/17 |

FOREIGN PATENT DOCUMENTS

| | | | |
|---|---|---|---|
| 510,587 | 6/1976 | U.S.S.R. | 415/17 |
| 209,057 | 10/1970 | United Kingdom | 415/1 |

OTHER PUBLICATIONS

Principles of Turbomachines, D. Sheppard; MacMillan Co., New York, 1956, pp. 217 and 218.

*Primary Examiner*—C. J. Husar

*Attorney, Agent, or Firm*—Beveridge, De Grandi, Kline & Lunsford

[57] ABSTRACT

Surging of a centrifugal compressor is avoided by ensuring that in operation $$Mn^2 \geqq \frac{K \cdot gh_p}{Vc^2} - k,$$

where K and k are parameters whose values depend on the characteristics of the compressor, g is the acceleration due to gravity, $h_p$ is the polytropic head produced by the compressor, Vc is the velocity of sound in said inlet gas, and Mn (the Mach Number) is the ratio of the flow velocity V of the gas at the inlet to the compressor to the velocity of sound Vc therein. This is normally effected by arranging that $$\frac{\Delta_p}{P_1} \geqq K \cdot \frac{P_2}{P_1} - k,$$

where $\Delta_p$ is the differential pressure across a throttling member disposed in an inlet duct of the compressor, $P_1$ is the compressor inlet pressure, and $P_2$ is the compressor outlet pressure.

11 Claims, 6 Drawing Figures

CONTROL OF CENTRIFUGAL COMPRESSORS

BACKGROUND OF THE INVENTION

This invention relates to the control of centrifugal compressors to prevent surging thereof.

If the volume of gas delivered by a centrifugal compressor falls below a predetermined limit, the compressor surges. For example, if the compressor is arranged to deliver a constant volume of air to a blast furnace, and the varying conditions in the blast furnace causes an increase in the resistance to the flow of the air through the compressor, the compressor will be required to deliver to the blast furnace a greater mass flow of air in order to maintain the said volume of air constant at the higher discharge pressure from the compressor. If, however, sufficient air is not available at the compressor inlet, the compressor will run out of air with the result that there will be a reverse flow of air through the compressor, i.e. a surge cycle will occur. If the resistance to the flow of air through the compressor is not then reduced, the surge cycle will be repeated until the correct volume of air flows through the compressor.

Such surging is highly undesirable since the resultant vibration, noise and overheating can lead to mechanical damage and ultimate wrecking of the compressor and of associated instrumentation and ducting connected thereto.

The compressor must therefore be controlled to prevent surging under all operating conditions, and this is normally achieved either by re-circulating, when necessary, a flow of the gas which has been compressed in the compressor from the outlet to the inlet thereof through a by-pass duct, or by blowing off some of the gas discharged from the compressor.

Precise surge control is desirable to increase the operating range of the compressor and to avoid unnecessary energy losses. Such precise surge control should be responsive to changes in the composition, inlet pressure and inlet temperature of the gas entering the compressor and, in many cases, should be such as to ensure that the compressor is operated as closely as possible to the surging condition in order to obtain the best efficiency.

The conventional method of defining the surge point, i.e., the conditions in which the compressor will surge, has consisted in determining the relationship between the outlet pressure of the compressor and the volumetric flow through the compressor inlet. The method is not sufficiently accurate however since it takes no account of variables such as pressure, temperature, molecular weight and supercompressability of the gas entering the compressor. Consequently, when this method is used, the compressor is liable to surge "for no apparent reason".

In an attempt to allow for some of these variables, compressor manufacturers often supply a family of curves defining surge, each such curve showing the said relationship between the outlet pressure and the inlet volumetric flow for predetermined conditions of inlet temperature and pressure. Not only, however, is it difficult in practice to use such a family of curves, but also it is by no means necessarily apparent in practice which particular curve is applicable since the value of a variable such as the said inlet pressure may not be very accurately known and does not necessarily remain constant. Consequently, it is not practicable to operate at all close to the surge point as defined by the respective curve, and this can mean that the compressor is necessarily very inefficiently operated.

Various attempts have therefore been made to control a centrifugal compressor otherwise than by merely determining the relationship between the outlet pressure of the compressor and the inlet volume thereof. For example, in British patent specification No. 1,209,057 the compressor is controlled in accordance with the formula $$\frac{h}{p_2 + \frac{b}{a} p_1} \geqq \frac{a}{\phi\psi^2}$$

where h is the pressure difference across a throttling element in the intake to the compressor, $p_1$ and $p_2$ are respectively the inlet and outlet pressures of the compressor, $\phi$ and $\psi$ are constants which depend respectively on the particular compressor and throttling element used, and a and b are constants which depend on the value of the compressor ratio $p_2/p_1$ and on the polytropic exponent n. This formula, however, is derived mathematically from the proposition that surging in a centrifugal compressor depends only on the angular velocity N of the compressor rotor, whereas in fact it also depends on the temperature T, the supercompressability Z, the ratio of the specific heats $\gamma$ and the molecular weight M.W. of the inlet gas. Consequently the said formula is applicable only to low values of the compression ratio.

SUMMARY OF THE INVENTION

According therefore to one aspect of the present invention, there is provided apparatus comprising a centrifugal compressor; means for producing in operation a first signal which is functionally related to the ratio $$\frac{gh_p}{Vc^2},$$

where g is the acceleration due to gravity, $h_p$ is the polytropic head produced by the compressor, and Vc is the velocity of sound in said inlet gas; means for producing in operation a second signal which is functionally related to $Mn^2$, where Mn (the Mach Number) is the ratio of the flow velocity V of the gas at the inlet to the compressor to the velocity of sound Vc therein; and control means, controlled by said first and second signals, for ensuring that in operation $$Mn^2 \geqq \frac{K \cdot gh_p}{Vc^2}$$

where K and k are parameters whose values depend on the characteristics of the compressor, whereby surging of the compressor is avoided.

Preferably the means for producing the first signal is responsive to the ratio $P_2/P_1$, where $P_1$ is the compressor inlet pressure, and $P_2$ is the compressor outlet pressure.

Preferably also the means for producing the second signal is responsive to the ratio $\Delta_p/nP_1$ where $\Delta_p$ is the differential pressure across a throttling member disposed in an inlet duct of the compressor, n is the polytropic exponent of the said gas, and $P_1$ is the compressor inlet pressure. In many cases n is a constant and may therefore for practical purposes be ignored.

The apparatus may comprise a duct having a control valve therein, communicates with the outlet end of the compressor, the said control means controlling opening and closing of the control valve.

The said duct may, for example, be a by-pass duct which is connected across the compressor between the inlet and outlet ends thereof. In this case, the by-pass duct preferably passes through a heat exchanger so that gas flowing from the said outlet end to the said inlet end is cooled.

Alternatively, the said duct may be a venting duct whose outlet end is open to atmosphere.

According to another aspect of the present invention, there is provided a method for controlling a centrifugal compressor comprising producing a first signal which is functionally related to the ratio $$\frac{gh_p}{Vc^2},$$

where g is the acceleration due to gravity, $h_p$ is the polytropic head produced by the compressor, and Vc is the speed of sound in said inlet gas; producing a second signal which is functionally related to $Mn^2$, where Mn (the Mach. Number) is the ratio of the flow velocity V of the gas at the inlet to the compressor to the velocity of sound Vc therein; and ensuring that $$Mn^2 \geqq \frac{K \cdot gh_p}{Vc^2} - k,$$

where K and k are parameters whose values depend on the characteristics of the compressor, whereby surging of the compressor is avoided. It may thus be arranged that $$Mn^2 \quad \frac{K \cdot gh_p}{Vc^2} - k.$$

It is preferably arranged that $$\frac{\Delta_p}{P_1} \geqq K \cdot \frac{P_2}{P_1} - k,$$

where $\Delta_p$ is the differential pressure across a throttling member disposed in an inlet duct of the compressor, $P_1$ is the compressor inlet pressure, and $P_2$ is the compressor outlet pressure.

It will thus be noted that the variables $\Delta_p$, $P_1$ and $P_2$ are used in a totally different way in the case of the present invention to the way in which similar variables are used in the case of British Pat. No. 1,209,057. Thus, in the case of British Pat. No. 1,209,057 the variable $P_2$ is added to a function of $P_1$, and the ratio of $\Delta_p$, to this addition is used to control the compressor. In the case of the present invention, however, the compressor is controlled in functional dependence upon the relationship of the ratio $$\frac{\Delta_p}{P_1}$$

to the ratio $$\frac{P_2}{P_1}.$$

DESCRIPTION OF THE PREFERRED EMBODIMENT

Figure 1:
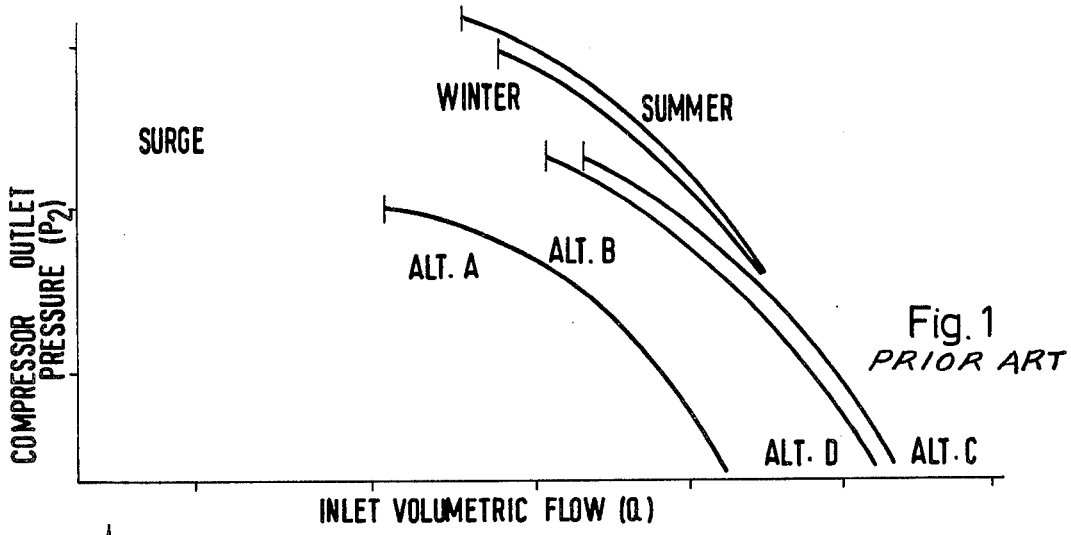
Fig. 1 PRIOR ART
Figure 2:
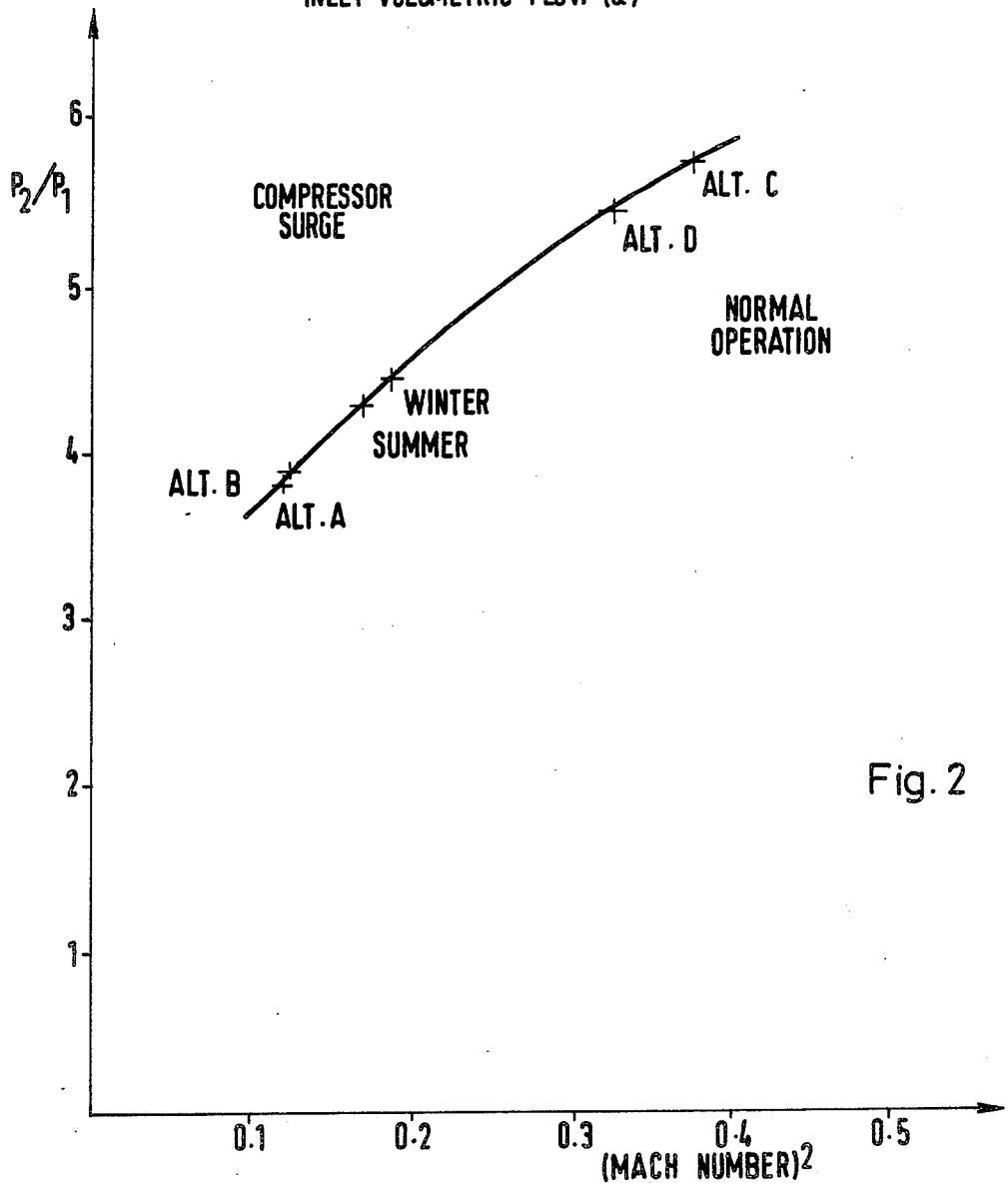
Figure 3:
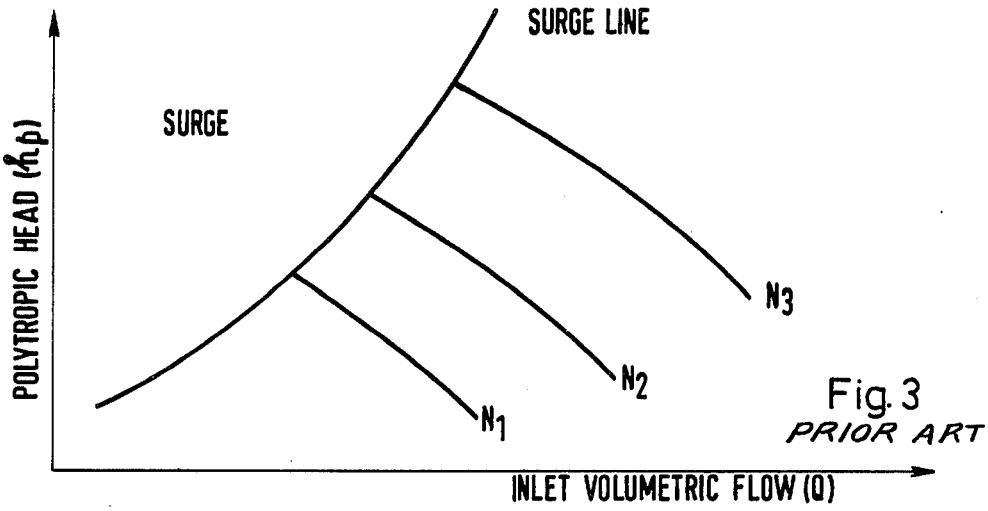
Fig. 3 PRIOR ART
Figure 4:
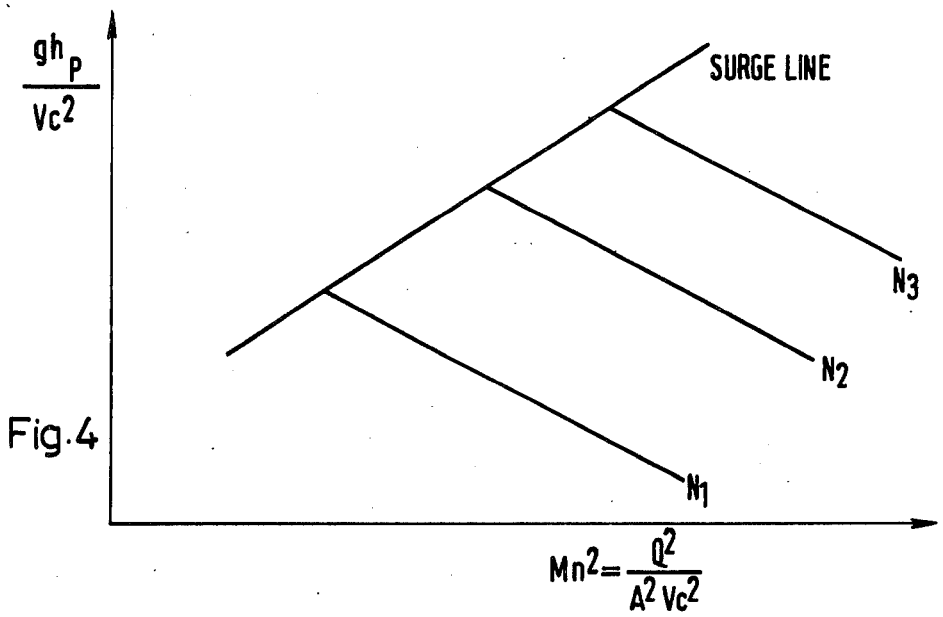
Figure 5:
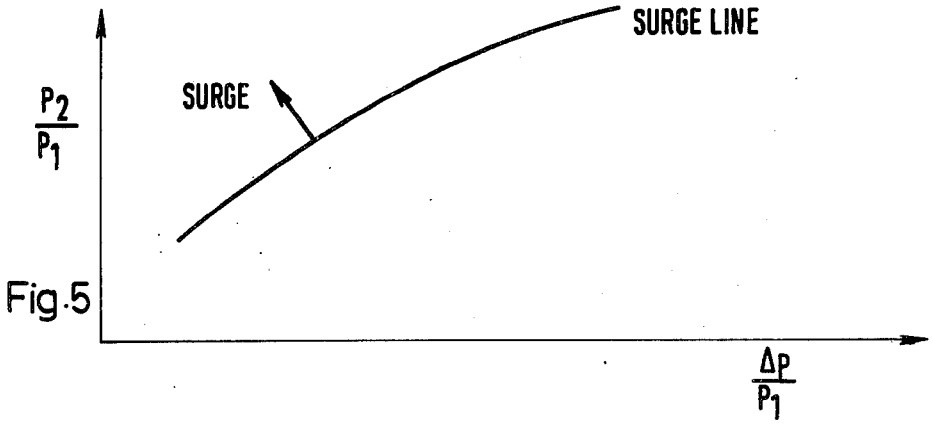
Figure 6:
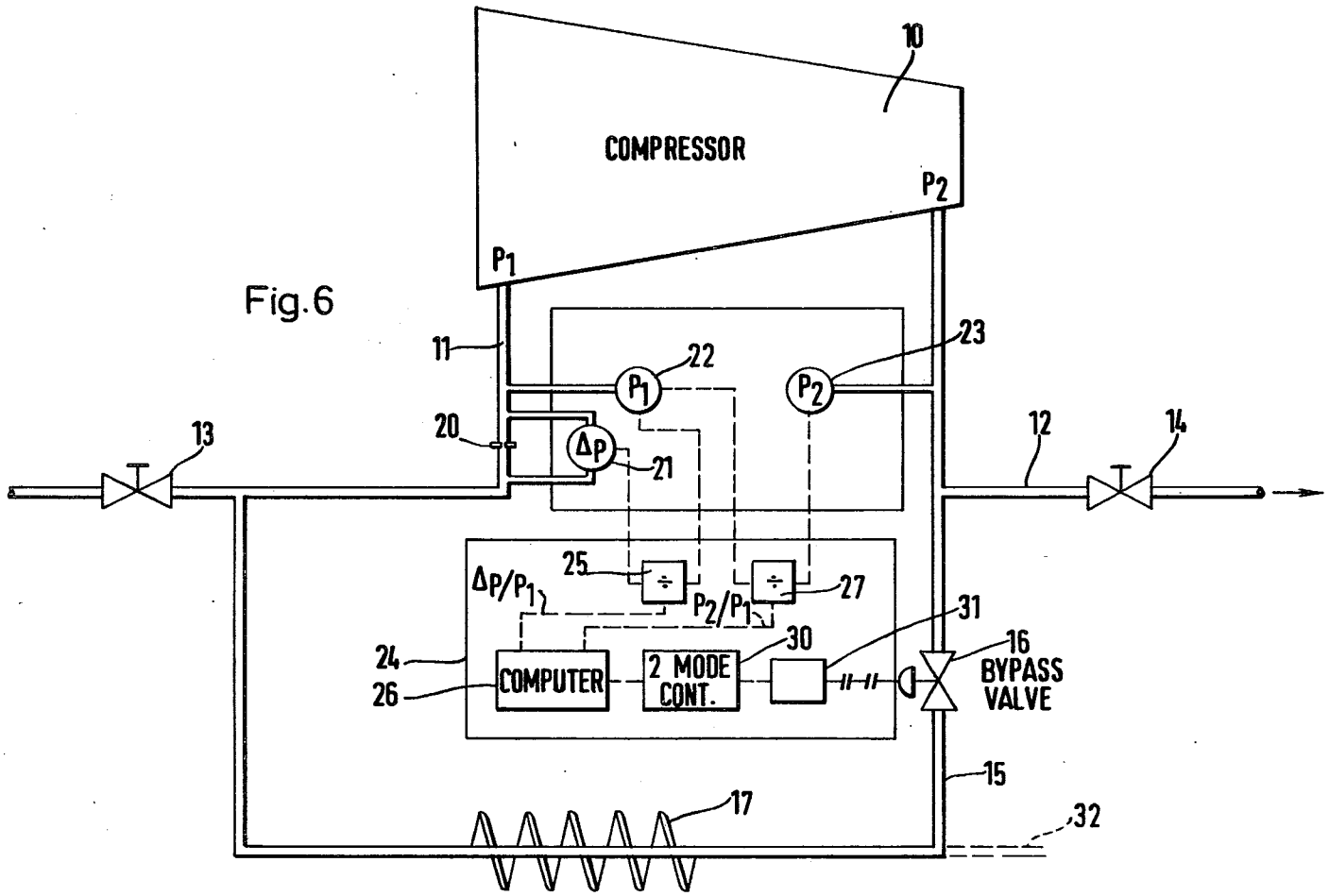

The invention is illustrated, merely by way of example in the accompanying drawings, in which:

FIG. 1 shows a known family of curves illustrating the relationship between the compressor outlet pressure $P_2$ and the inlet volume flow Q through the compressor for varying conditions, FIG. 2 is a graph showing the relationship according to the present invention, between the compression ratio $P_2/P_1$ and $Mn^2$, the square of the Mach Number of the gas entering the compressor, FIG. 3 is a graph showing the known relationship between the polytropic head $h_p$ produced by the compressor and the inlet volumetric flow Q through the compressor, FIG. 4 is a graph showing the relationship according to the present invention between the ratio $$\frac{gh_p}{Vc^2}$$

and $Mn^2$,

FIG. 5 is a graph showing the relationship according to the present invention between the compression ratio $P_2/P_1$ and the ratio $\Delta_p/P_1$, and FIG. 6 is a schematic drawing of an apparatus according to the present invention.

In FIG. 1 there is shown a known family of curves illustrating the relationship between the compressor outlet pressure $P_2$ and the inlet volumetric flow Q through the compressor for one particular compressor. Curves of the sort shown in FIG. 1 are commonly produced by compressor manufacturers for use of their customers. As will be seen from FIG. 1, each curve relates to a specific temperature T (Winter/Summer) and a specific compressor inlet pressure $P_1$ (at Altitudes A, B, C or D). There are thus a number of discontinuous curves which end in a surge region on a somewhat random basis, and such curves not only represent an over-simplification, in that for instance they take no account of gas molecular weight and supercompressability, but they are also extremely difficult to use in practice and make no allowance for varying conditions of temperature and pressure.

The present invention is based on the discovery that if, as shown in FIG. 2, the compression ratio $P_2/P_1$ is plotted against $Mn^2$ (Mn being the Mach Number, i.e., the ratio of the flow velocity V of the gas at the inlet to the compressor to the velocity of sound Vc therein), then all the information provided by the said family of curves will be given by a single curve representing the surge line, and this single curve will be readily usable for control purposes since it concerns the relationship between non-dimensional similarity parameters. Moreover, as indicated below, this single curve may readily be linearlised and can account correctly for changes in compressor inlet pressure $P_1$, compressor inlet temperature T, the molecular weight M.W. of the inlet gas, and the ratio of the specific heats $\gamma$ of the gas.

Compressor theory normally starts from incompressible fan theory in which the accepted non-dimensional similarity parameters used to plot the performance of the fan are $g\,h/N^2.D^2$ and $Q/ND^3$, where g is the acceleration due to gravity, h is the head of gas produced across the fan, N is the rotational speed of the fan, D is the diameter of the fan, and Q, as indicated above, is the inlet volumetric flow to the fan. In the case of the compressible flow which occurs in a centrifugal compressor, the said head h is replaced by the polytropic head $h_p$ produced by the compressor, and the value of the latter may be derived from the expressions:

$$h_p = \int_1^2 \frac{dP}{g\rho}, \text{ and}$$

$$P = C \cdot \rho^n,$$

where $\rho$ is the mass density of the said inlet gas, n is the polytropic exponent of the compression process, and C is a constant which depends on the gas. This gives the equation $$g\,h_p = \frac{n}{n-1}\,\frac{P_1}{\rho_1}\left[\left(\frac{P_2}{P_1}\right)^{\frac{n-1}{n}} - 1\right] \quad (1)$$

However when preparing a graph to show the position of the surge line it has been conventional, as shown in FIG. 3, to plot the polytropic head, $h_p$, against the inlet volumetric flow Q. This, however, is not satisfactory because the result is not non-dimensional and because the polytropic head $h_p$ cannot be measured directly. Moreover, the polytropic head $h_p$ is very difficult to calculate since, as indicated by the equation (1), it depends on the compression ratio $P_2/P_1$, the polytropic exponent n, the molecular weight M.W. of the inlet gas, the supercompressibility Z of the gas, and the compressor inlet temperature T.

As indicated above, the Mach Number Mn is the ratio of the flow velocity V of the gas at the inlet to the compressor to the velocity of sound therein. Thus, $$Mn = V/Vc.$$

The velocity of sound may be derived from the equation $Vc^2 = dP/d\rho$ and, for the polytropic process by the equation $$Vc^2 = n\,P/\rho = nRTZ/G \quad (2)$$

where R is the gas constant, and G is the specific gravity of the inlet gas.

Consequently the equation (2) can be used to non-dimensionalise the surge line graph shown in FIG. 3, in which the polytropic head $h_p$ is plotted against the inlet volumetric flow Q, to give that shown in FIG. 4, in which the ratio $$\frac{gh_p}{Vc^2}$$

is plotted against $$Mn^2 = \frac{Q^2}{A^2\,Vc^2},$$

where A is the inlet area of the compressor.

The area above the surge line shown in FIG. 4 is the area in which surging will occur. Consequently, if surging is to be avoided, $$Mn^2 \geqq \frac{K \cdot gh_p}{Vc^2} - k,$$

where K and k are parameters dependent on the shape of the surge line and are thus parameters whose values depend on the characteristics of the compressor. These parameters K and k can be easily and exactly determined in practice by plotting the surge line on the axes shown in FIG. 4 either by using information provided by the compressor manufacturer for the benefit of his customers or by obtaining such information from the results of conventional experiments.

As will be appreciated from the above, $$\frac{Q}{A\,Vc} = Mn, \text{ and}$$

$$\frac{gh_p}{Vc^2} = \frac{1}{n-1}\left[\left(\frac{P_2}{P_1}\right)^{\frac{n-1}{n}} - 1\right]$$

It can be seen that $$\frac{gh_p}{Vc^2}$$

is a weak function of n, but is a strong function of the compression ratio $P_2/P_1$.

Therefore we may write as an approximation $$\frac{gh_p}{Vc^2} \propto \frac{P_2}{P_1}$$

If a throttling member is disposed in the intake to the compressor, the differential pressure $\Delta p$ across the throttling member is in accordance with the expression $\Delta p \propto \rho V^2$. Thus by using the equation $Vc^2 = nP/\rho$ of equation (2), we obtain $$Mn^2 = \frac{V^2}{Vc^2} \propto (\Delta p/\rho/nP_1/\rho) = \Delta p/nP_1 \quad (3)$$

Furthermore, if n is almost constant, this simplifies to $$Mn^2 \simeq \Delta p/P_1.$$

Thus a very good approximation to compressor performance and surge control would be given by the graph shown in FIG. 5 where the compression ratio $P_2/P_1$ is plotted against the ratio $\Delta p/P_1$. In this case surge control can be effected merely by measuring the variables $P_1$, $P_2$, and $\Delta p$, as in the schematic embodiment shown in FIG. 6.

If n is not a constant, it may be treated as a function of G, the specific gravity of the gas. For example, for natural gas $n = 1.4727 - 0.280G$. G itself can be measured directly by a specific gravity meter or calculated from the expression $$G = \frac{ZTp}{p.}$$

In FIG. 6 there is shown a centrifugal compressor 10 having an inlet duct 11 and an outlet duct 12. The inlet duct 11 and outlet duct 12 have respective flow valves 13, 14 therein. A by-pass duct 15, having a by-pass valve 16 therein, is connected across the compressor 10 between the inlet and outlet ends thereof and communicates with the inlet duct 11 and outlet duct 12. The by-pass duct 15 preferably passes as shown through a heat-exchanger 17 so that a by-pass flow of gas flowing through the by-pass duct 15 from the outlet end to the inlet end of the compressor is cooled in passing through the heat exchanger 17.

Disposed in the inlet duct 11 is a throttling member 20 the differential pressure $\Delta p$ across which is measured by a transducer 21. The inlet pressure $P_1$ to the compressor 10, i.e., downstream of the throttling member 20, is measured, by a transducer 22, while the outlet pressure $P_2$ from the compressor is measured by a transducer 23.

A control means 24, which controls opening and closing of the by-pass valve 16, comprises a divider 25 which receives signals from the transducers 21, 22. The divider 25 produces an output signal which is dependent upon the ratio $\Delta p/P_1$ and which is passed to an analogue or digital computer 26. Thus the output signal from the divider 25 is functionally related to $Mn^2$.

The control means 24 also comprises a divider 27 which receives signals from the transducers 22, 23. The divider 27 produces an output signal which is dependent upon the ratio $P_2/P_1$ and which is passed to the computer 26. Thus the output signal from the divider 27 is functionally related to the ratio $$\frac{gh_p}{Vc^2}.$$

The computer 26 compares the values of $$\frac{P_2}{P_1} \text{ and } \frac{\Delta p}{P_1}$$

with pre-programmed information and provided that $$\frac{\Delta p}{P_1} \geqq K \cdot \frac{P_2}{P_1} - k$$

the by-pass valve 16 is maintained closed. However if $$\frac{\Delta p}{P_1} < K \cdot \frac{P_2}{P_1} - k,$$

a signal is passed to a two mode controller 30 which opens the by-pass valve 16. Thus surging is avoided.

Alternatively, the by-pass valve 16 may be pneumatically operated, in which case a current to pneumatic converter 31 is interposed between the two mode controller 30 and the by-pass valve 16.

If desired, the duct 15, instead of being a by-pass duct, could be a venting duct whose inlet end communicates with the outlet end of the compressor 10 the venting duct 15 having an outlet end 32 which is open to atmosphere.

We claim:

1. Apparatus comprising a centrifugal compressor; means for producing in operation a first signal which is functionally related to the ratio $$\frac{gh_p}{Vc^2},$$

where g is the acceleration due to gravity, $h_p$ is the polytropic head produced by the compressor, and Vc is the velocity of sound in inlet gas entering the compressor; means for producing in operation a second signal which is functionally related to $Mn^2$, where Mn (the Mach Number) is the ratio of the flow velocity V of the gas at the inlet to the compressor to the velocity of sound Vc therein; and control means for preventing surging of the compressor, said control means being controlled by said first and second signals, and ensuring that in operation $$Mn^2 \geqq \frac{K \cdot gh_p}{Vc^2}$$

where K and k are parameters whose values depend on the characteristics of the compressor.

2. Apparatus as claimed in claim 1 in which the means for producing the first signal is responsive to the ratio $P_2/P_1$, where $P_1$ is the compressor inlet pressure and $P_2$ is the compressor outlet pressure.

3. Apparatus as claimed in claim 1 in which the means for producing the second signal is responsive to the ratio $\Delta p/n\ P_1$ where $\Delta p$ is the differential pressure across a throttling member disposed in an inlet duct of the compressor, n is the polytropic exponent of the said gas, and $P_1$ is the compressor inlet pressure.

4. Apparatus as claimed in claim 3 in which n is a constant.

5. Apparatus comprising a centrifugal compressor; means for producing in operation a first signal which is functionally related to the ratio $$\frac{gh_p}{Vc^2},$$

where g is the acceleration due to gravity, $h_p$ is the polytropic head produced by the compressor, and Vc is the velocity of sound in inlet gas entering the compressor; means for producing in operation a second signal which is functionally related to $Mn^2$, where Mn (the Mach Number) is the ratio of the flow velocity V of the gas at the inlet of the compressor to the velocity of sound Vc therein; control means which are controlled by said first and second signals and which ensure that in operation $$Mn^2 \geqq \frac{K \cdot gh_p}{Vc^2} - k,$$

where K and k are parameters whose values depend on the characteristics of the compressor, and a duct, having a control valve therein, which communicates with the outlet end of the compressor, the said control means controlling opening and closing of the control valve, whereby surging of the compressor is avoided.

6. Apparatus as claimed in claim 5 in which the said duct is a by-pass duct which is connected across the compressor between the inlet and outlet ends thereof.

7. Apparatus as claimed in claim 6 in which the by-pass duct passes through a heat exchanger so that gas flowing from the said outlet end to the said inlet end is cooled.

8. Apparatus as claimed in claim 5 in which the said duct is a venting duct whose outlet end is open to atmosphere.

9. A method of controlling a centrifugal compression producing a first signal which is functionally related to the ratio $$\frac{gh_p}{Vc^2},$$

where g is the acceleration due to gravity, $h_p$ is the polytropic head produced by the compressor, and Vc is the speed of sound in inlet gas entering the compressor; producing a second signal which is functionally related to $Mn^2$, where Mn (the Mach Number) is the ratio of the flow velocity V of the gas at the inlet to the compressor to the velocity of sound Vc therein; and employing said first and second signals to prevent surging of the compressor by ensuring that $$Mn^2 \geqq K \cdot \frac{g\,h_p}{Vc^2} - k$$

where K and k are parameters whose values depend on the characteristics of the compressor.

10. A method as claimed in claim 9 in which it is arranged that $$Mn^2 \quad \frac{K \cdot gh_p}{Vc^2} - k.$$

11. A method as claimed in claim 9 in which it is arranged that $$\frac{\Delta_p}{P_1} \geqq K \cdot \frac{P_2}{P_1} - k,$$

where $\Delta_p$ is the differential pressure across a throttling member disposed in an inlet duct of the compressor, $P_1$ is the compressor inlet pressure, and $P_2$ is the compressor outlet pressure.

* * * * *

UNITED STATES PATENT OFFICE

CERTIFICATE OF CORRECTION

PATENT NO. : 4,156,578

DATED : May 29, 1979

INVENTOR(S) : JORAM AGAR and KLAUS J. ZANKER

It is certified that error appears in the above-identified patent and that said Letters Patent are hereby corrected as shown below:

Column 2, line 52, show the correct equation as follows:

$$-- \; Mn^2 \geqslant \frac{K.gh_p}{Vc^2} - k, \; --$$

Column 3, line 38, show the correct equation as follows:

$$-- \; Mn^2 \simeq \frac{K.gh_p}{Vc^2} - k. \; --$$

Column 8, line 5 (claim 1), show the correct equation as follows:

$$-- \; Mn^2 \geqslant \frac{K.gh_p}{Vc^2} - k, \; --$$

UNITED STATES PATENT OFFICE

CERTIFICATE OF CORRECTION

PATENT NO. : 4,156,578 Page 2 of 2

DATED : May 29, 1979

INVENTOR(S) : JORAM AGAR and KLAUS J. ZANKER

It is certified that error appears in the above-identified patent and that said Letters Patent are hereby corrected as shown below:

Column 10, line 2 (claim 10), show the correct equation as follows:

$$-- Mn^2 \frac{K.\ g\ h_p}{Vc^2} - k. --$$

Signed and Sealed this

*Twenty-sixth* Day of *February 1980*

[SEAL]

*Attest:*

SIDNEY A. DIAMOND

*Attesting Officer*

*Commissioner of Patents and Trademarks*